US007955022B2

(12) United States Patent
Raymond

(10) Patent No.: US 7,955,022 B2
(45) Date of Patent: Jun. 7, 2011

(54) ELONGATE SLEEVE RETENTION DEVICE AND USES THEREOF

(75) Inventor: Richard Raymond, Newberry, OH (US)

(73) Assignee: Thermoprene, Inc., Chagrin Falls, OH (US)

( * ) Notice: Subject to any disclaimer, the term of this patent is extended or adjusted under 35 U.S.C. 154(b) by 476 days.

(21) Appl. No.: 11/268,896

(22) Filed: Nov. 8, 2005

(65) Prior Publication Data

US 2007/0104536 A1 May 10, 2007

(51) Int. Cl.
*E01F 9/03* (2006.01)

(52) U.S. Cl. ..... 404/9; 248/615

(58) Field of Classification Search ..... 40/607.1, 40/607.12; 404/9; 116/63 R; 256/1; 248/615
See application file for complete search history.

(56) References Cited

U.S. PATENT DOCUMENTS

| | | | | | |
|---|---|---|---|---|---|
| 2,450,345 | A * | 9/1948 | Kervin | 52/301 |
| 4,092,079 | A * | 5/1978 | Swanson | 403/306 |
| 4,244,156 | A * | 1/1981 | Watts, Jr. | 52/746.1 |
| 4,619,456 | A * | 10/1986 | Meggs | 473/471 |
| 4,644,722 | A * | 2/1987 | Phillips | 52/514 |
| 4,702,057 | A * | 10/1987 | Phillips | 52/514 |
| 4,961,258 | A * | 10/1990 | Menzel | 52/745.17 |
| 4,981,226 | A * | 1/1991 | Shallenberg et al. | 211/189 |
| 5,039,100 | A * | 8/1991 | Cortese | 273/127 B |
| 5,323,583 | A | 6/1994 | Venegas, Jr. | |
| 6,179,273 | B1 * | 1/2001 | Edmunds et al. | 256/13.1 |
| 6,209,276 | B1 | 4/2001 | Venegas, Jr. | |
| 6,755,005 | B2 * | 6/2004 | Czachor et al. | 52/736.4 |
| 2006/0104715 | A1 * | 5/2006 | Newton | 404/9 |
| 2006/0113515 | A1 * | 6/2006 | Venegas, Jr. | 256/1 |

* cited by examiner

*Primary Examiner* — Gary S Hartmann
(74) *Attorney, Agent, or Firm* — Fay Sharpe LLP

(57) ABSTRACT

An elongate sleeve retention device adapted to securely retain an elongate sleeve on a post-like structure about which it is disposed. In a preferred embodiment, the retention device of the present invention is configured to interface between a bollard and a bollard cover, and cause the bollard cover to resist inadvertent dissociation from the bollard.

16 Claims, 4 Drawing Sheets

ELONGATE SLEEVE RETENTION DEVICE AND USES THEREOF

FIELD OF THE INVENTION

The present invention is directed to an elongate sleeve retention device and uses thereof. More particularly, the present invention is directed to a device adapted to securely retain an elongate sleeve, such as a bollard cover, on a post-like structure, such as a bollard.

BRIEF DISCUSSION OF THE RELATED ART

A structure conventionally known as a bollard is often disposed, either solely or in plural, as a protective structure near a guarded item to prevent accidental contact of a movable item (e.g., automobile) with the guarded item. As known, a bollard is a generally elongate and cylindrical structure, often featuring a rounded top portion, typically disposed and/or anchored vertically relative to a substrate (e.g., a parking lot, ground, a floor, and the like). For example, items such as industrial refuse containers, building entrance ways, and the like are susceptible to significant damage if an automobile, cart, etc. comes into accidental contact with the item. Accordingly, one or more bollards are disposed in front of such items as reinforced impediments to prevent such accidental contact.

A bollard, given its application, is often constructed from concrete or similar reinforced and durable material. Because such material usually provides less than satisfactory aesthetic appearance, an elongate sleeve (e.g., a bollard cover), featuring an aesthetic appearance, is often disposed about a bollard. Bollard covers are generally complementary in shape to bollards, i.e., elongate and hollow cylindrical members open along one end thereof, which open end provides a means for passing the bollard cover onto a bollard.

Once a bollard cover is disposed about a corresponding bollard, it displays a natural tendency to become dislodged and/or dissociated from the bollard. Whether due to gusts of wind, repeated contact or individual malfeasance, the sleeve nature of bollard covers predisposes them to such dissociation. Accordingly, there exists a need for a device that securely retains a bollard cover about a corresponding bollard.

BRIEF SUMMARY OF THE INVENTION

In accordance with one example aspect, the present invention is directed to a retaining device adapted for retaining an elongate sleeve about an elongate member. The retaining device generally includes a substantially rectangular base member having a front face, a rear face, a longitudinal axis and a lateral axis, and wherein the base member is adapted to be associated with an elongate member; an engaging means, associated with the front face of the base member, adapted for engaging an inner surface of an elongate sleeve; and an associating means, associated with the rear face of the base member, adapted for associating the retaining device to the elongate member.

In accordance with another example aspect, the present invention is also directed to a bollard cover retaining system for retaining a bollard cover relative to a bollard about which the bollard cover is disposed. The system generally includes an elongate bollard; a retaining device comprising a substantially rectangular base member having a front face, a rear face, a longitudinal axis and a lateral axis, and wherein the base member is associated with the bollard; an engaging means, associated with the front face of the base member, and an associating means, associated with the rear face of the base member and with the bollard; and a bollard cover disposed about the bollard and associated retaining device.

In accordance with yet another example aspect, the present invention is directed to a retaining device adapted for retaining an elongate sleeve about an elongate member. The retaining device generally includes a substantially rectangular base member having a front face, a rear face, a longitudinal axis and a lateral axis, a shoulder associated along an edge of the rear face and extending substantially parallel to the lateral axis of the rear face, and wherein the base member is adapted to be associated with an elongate member; an engaging means, associated with the front face of the base member, comprising at least one projecting member having an end portion that is adapted to frictionally engage the inner surface of the elongate sleeve; and an associating means, associated with the rear face of the base member, adapted for associating the retaining device to the elongate member.

BRIEF DESCRIPTION OF THE DRAWINGS

These and other features and a more thorough understanding of the present invention may be achieved by referring to the following description and claims, taken in conjunction with the accompanying drawings, wherein:

DETAILED DISCUSSION OF EXAMPLE EMBODIMENTS

Disclosed according to the present invention is an elongate sleeve retention device adapted to interface between an elongate sleeve and a structure about which the elongate sleeve is disposed, and oppose and/or generally prevent inadvertent dissociation of the sleeve from the structure. The device of the present invention has particular application to a structure known as a bollard and an elongate sleeve therefor, such as a sleeve known as a bollard cover, aspects of which have been described supra. As will be more fully explained hereinafter, the retention device of the present invention is particularly adapted to securely engage a bollard cover relative to a corresponding bollard. However, despite this preferred application, it is to be appreciated that the retention device of the present invention may suitably be employed in connection with retaining any structure for which it may be adapted to do so.

Figure 1:
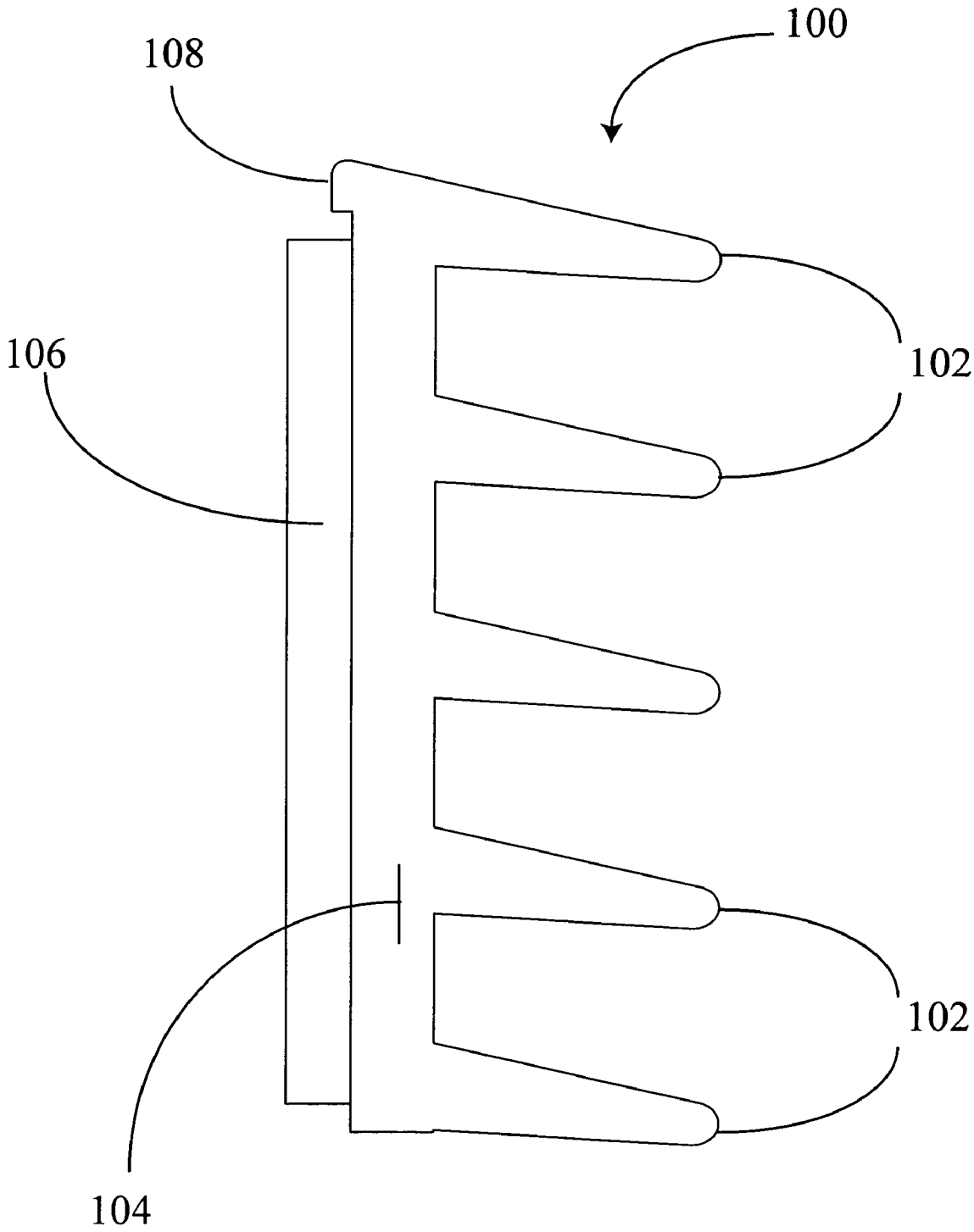
FIG. 1 is a side plan view of an example elongate sleeve retention device according to the present invention.
Figure 2:
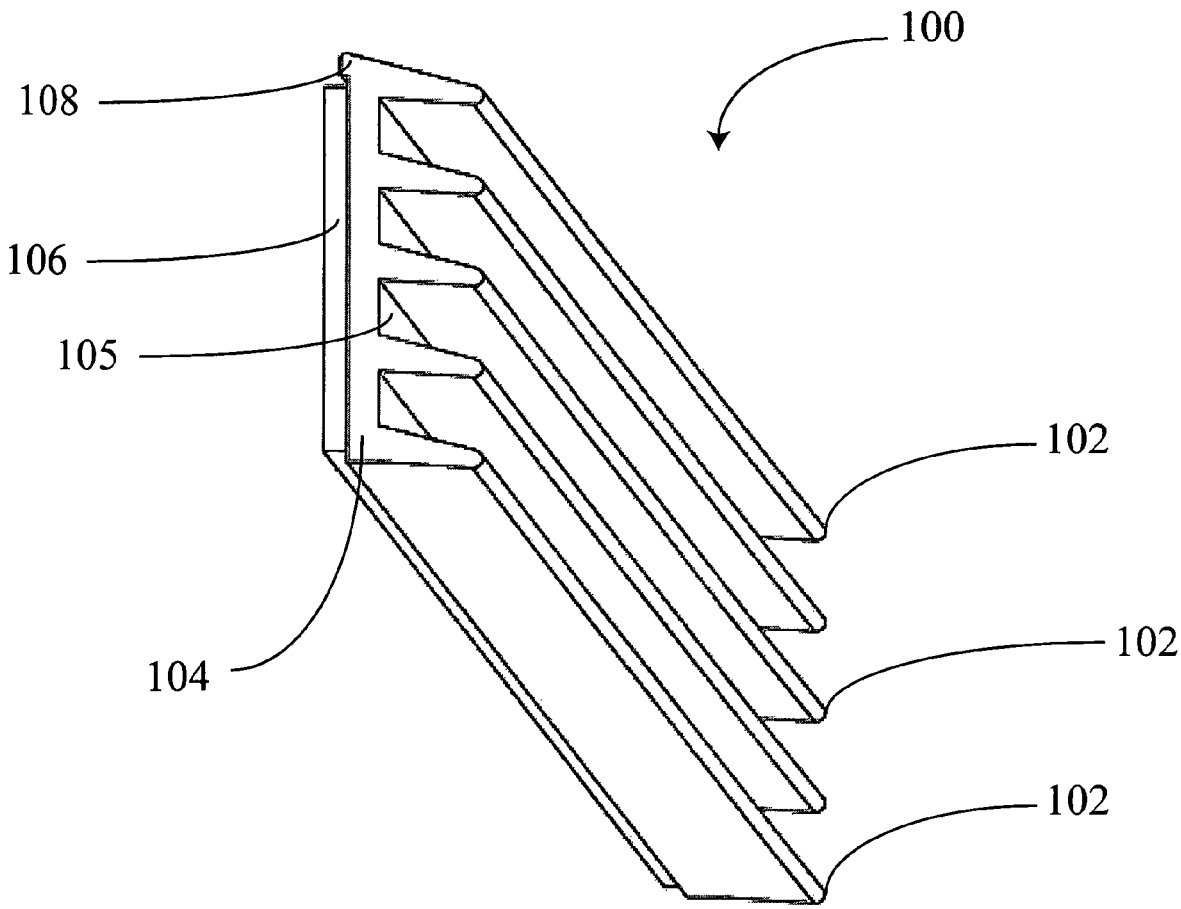
FIG. 2 is a perspective view of the retention device of FIG. 1.
Figure 3:
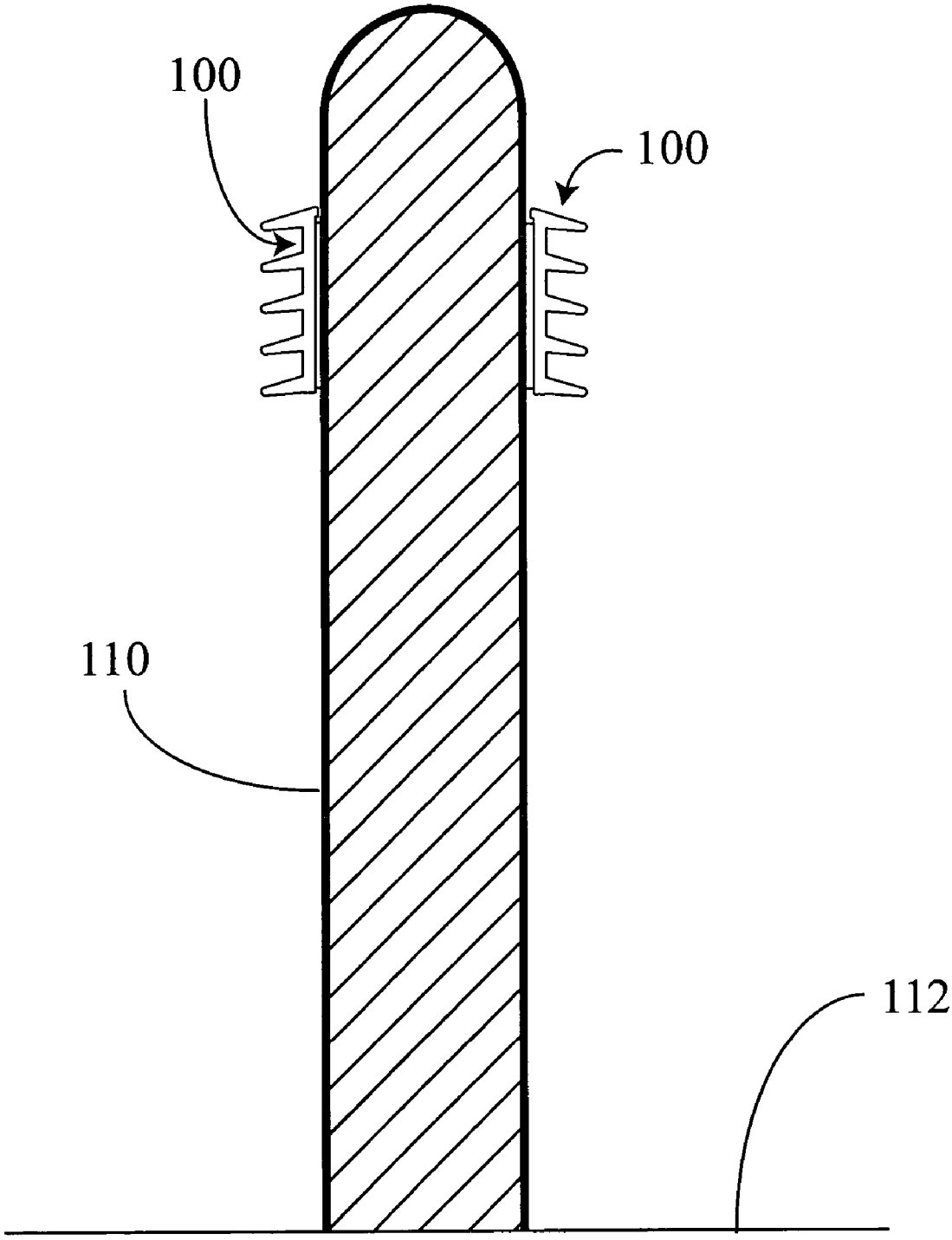
FIG. 3 is a side plan view of an elongate structure having a plurality of retention devices of FIGS. 1 and 2 associated therewith.
Figure 4:
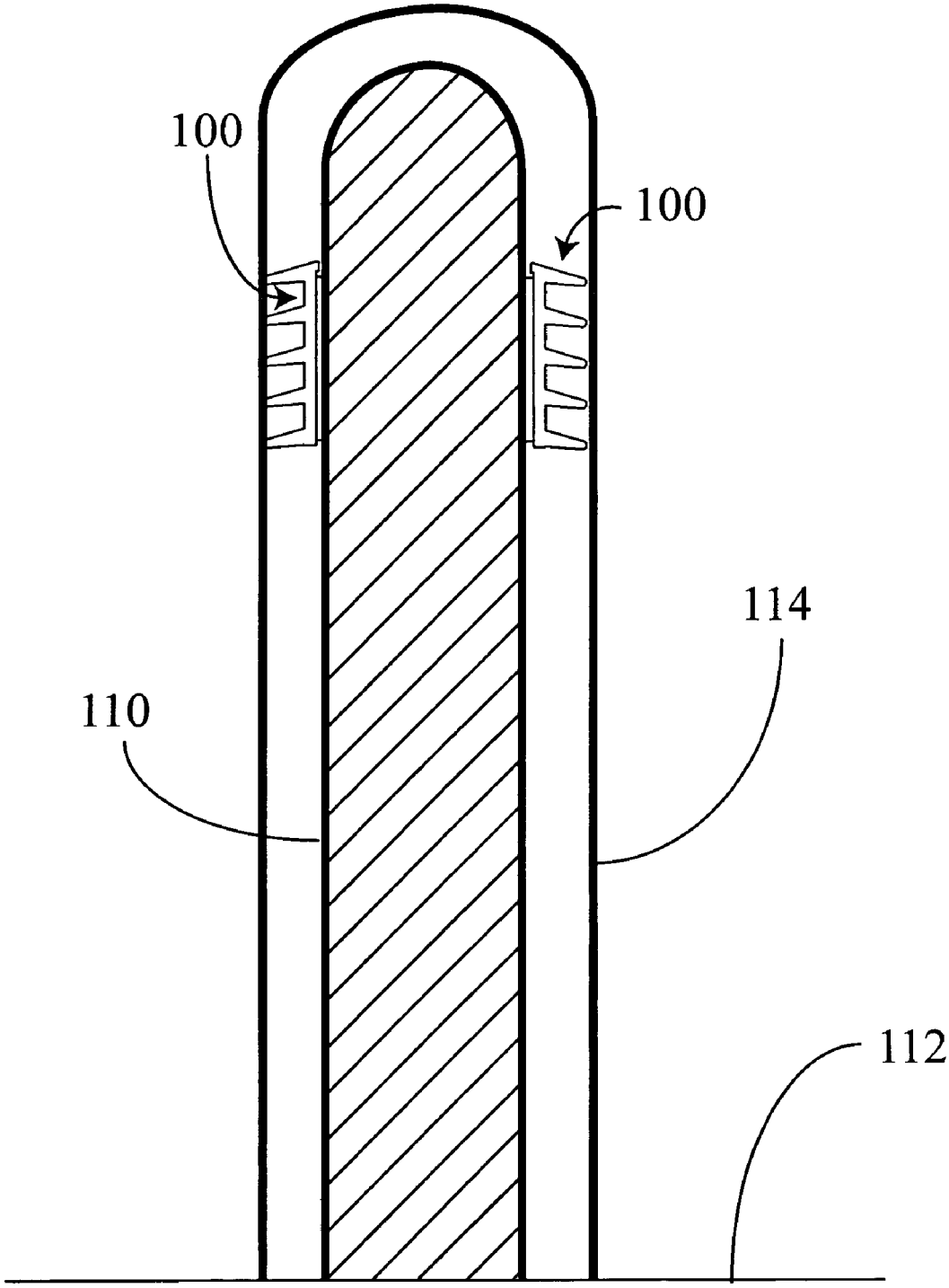
FIG. 4 is a side plan view of the elongate structure and associated retention devices of FIG. 2, wherein an elongate sleeve is disposed about the structure and devices.

Turning now to FIGS. 1 and 2, illustrated is an example, albeit preferred, embodiment of an elongate sleeve retention device 100 according to the present invention. As will be more fully explained hereinafter, the device 100 is generally configured to be securely associated with a post-like structure, preferably a bollard, and provide a retaining means that engages a sleeve, preferably a bollard cover, disposed about the post-like structure, and generally prevent inadvertent dissociation of the sleeve from the post-like structure. FIGS. 3 and 4 illustrate such a preferred application. By way of brief overview, FIG. 3 illustrates an example bollard 110, disposed on a substrate 112, and having a plurality of retention devices 100 associated with an upper portion thereof. FIG. 3 illustrates the bollard 110 and associated retention devices 100 of FIG. 2 with a bollard cover 114 disposed thereabout, and wherein the retention devices 100 are cooperating to prevent inadvertent dissociation of the bollard cover 114 relative to the bollard 110. A more thorough discussion of particular applications of the retention device 100 will follow.

Returning to FIGS. 1 and 2, the preferred retention device 100 of the present invention generally includes a base portion 104, an elongate sleeve engaging means 102 extending therefrom, and an associating means 106 for associating the device 100 to a bollard or similar structure. The base portion 104 is preferably provided as a substantially rectangular member, generally featuring a pair of opposed and spaced apart top 105 and bottom 107 faces, respectively, and a two pairs of opposed and spaced apart side faces. The top face 105 of the base portion 104 is preferably a component of the device 100 configured to generally face an inside surface 115 of an elongate sleeve 114; the bottom face 107 of the base portion 104 is preferably a component of the device 100 configured to generally face the bollard 110 or similar structure. The base portion 104 preferably also includes a flange-like shoulder 108 associated with bottom face 107, even more preferably along a portion of the bottom face 107 disposed near an edge area thereof. Various additional aspects of the base portion 104 will be more fully described hereinafter in connection with further components of the device 100.

The elongate sleeve retention device of the present invention preferably also includes the engaging means 102 for engaging the inside surface 115 of the elongate sleeve 114. As previously mentioned, the device 100 is generally configured to be securely associated with the bollard 110 or similar structure, about which the elongate sleeve 114 is preferably disposed. Accordingly, the engaging means 102 of the device provides an interface between the bollard 110 and the elongate sleeve 114, which interface suitably operates to prevent inadvertent dissociation of the sleeve 114 relative to the bollard 110.

The device 100 engaging means 102 may be provided as any suitable member and/or structure that accomplishes the interface aims of the present invention. FIGS. 1 and 2 illustrate a preferred and exemplary embodiment of the engaging means 102 as constituted by a plurality of flange-like fingers 102 extending from the top face 105 of the base portion 104, and organized generally seriatim thereon. The fingers 102 preferably extend from the base portion 104 and gradually taper into rounded tips, which tips are generally configured to remain in abutting contact with the elongate sleeve 114 disposed thereabout.

With best reference to FIG. 2, the fingers 102 are preferably provided as flap-like members that extend continuously along the base portion 104 front face 105. Even more preferably, the fingers 102 extend laterally along the base portion 104, so that the longitudinal axis of the individual fingers 102 is disposed generally perpendicular to the longitudinal axis of the bollard 110 or similar structure to which the device 100 is associated. As will be more fully explained hereinafter, the longitudinal axis of the fingers 102 is also oriented generally perpendicularly to the longitudinal axis of the elongate sleeve 114 disposed over the bollard 110, thereby providing a high degree of resistance to removal of the bollard cover 114 from the bollard 110.

With continued reference to FIG. 1, the fingers 102 preferably extend from the base portion 104 angularly. The angular orientation of the fingers 102 is preferably configured so that the fingers 102 extend downward when the device 100 is associated with a bollard 110, as illustrated in FIG. 2. Such downward angular orientation suitably facilitates installation of a bollard cover 114, as will be more fully described hereinafter.

The fingers 102 may be disposed at any angular orientation suitable to the aims of the present invention. Given the preferred downward angular orientation, the fingers 102 preferably extend, relative to an oblique angle, at an angle greater than 90 degrees. Even more preferably, the fingers 102 extend at an angle at about 95 degrees to about 150 degrees, even more preferably about 100 degrees to about 125 degrees, most preferably about 105 degrees.

The retention device 100 of the present invention suitably also includes the associating means 106 adapted for securely associating the device 100 to a bollard 110. In a preferred embodiment, the associating means 106 is preferably disposed in association with the body portion 104 bottom face 107, so as to be in general opposition to the device 100 fingers 102. The associating means 106 may be provided as any structure suitable for and capable of securely associating the device 100 to a bollard 110 or similar structure. In a preferred embodiment, the associating means 106 is provided as an article displaying adhesive properties, such a length of tape featuring a pressure sensitive adhesive, or similar article. Despite the foregoing, it is to be appreciated that the device 100 may be associated with the bollard 110 or similar structure through any appropriate and/or suitable means, including, by way of example, mechanical fasteners, straps or any other suitable item.

Returning to a discussion of the base portion 104, the base portion 104 preferably also includes the shoulder 108 for cooperating with the associating means 106 to retain the device 100 in association with the bollard 110 or similar structure. By way of more detailed discussion of the shoulder 108, the shoulder 108 is preferably oriented on the base portion 104 bottom face 107 as a structure extending generally parallel to the longitudinal axis of the fingers 102. In this configuration, when the device 100 is associated with the bollard 110 or similar structure, the shoulder 108 is disposed above the associating means 106. In the embodiment in which the associating means 106 is provided as an adhesive-like material, the disposition of the shoulder 108 above the associating means 106 provides a means for strengthening the association between the device 100 and the bollard 110. More specifically, once the device 100 associating means 106 has been associated with the bollard 110 and a bollard cover 114 is slid over the bollard 110 and associated device(s) 100, the downward pressure of the cover 114 may drive the device 100 base portion 104 to disengage from the associating means 106. Accordingly, the presence of the shoulder 108 above the associating means 106 provides a reinforcement against the base portion 104 from disengaging from the associating means 106.

The retention device 100 of the present invention may be constructed of any suitable material and by any suitable manufacturing process. In a preferred embodiment, device 100 is constructed of a polymeric material, even more preferably a polymeric material displaying at least a degree of flexibility, such as a TPE, flexible PVC or other suitable material. In an also preferred embodiment, the device 100 is constructed for an appropriate polymeric-suitable manufacturing method, such as injection molding, extrusion and the like. Most preferably, an extrusion approach is employed utilizing a die generally mirroring the overall configuration of the device 100 as depicted in FIG. 1.

An example method for utilizing the device 100 of the present invention will now be discussed. The method generally begins by first identifying a target bollard 110 and then providing a retention device 100 of the present invention. The device 100 is then associated through its associating means 106 with, preferably, an upper portion of the bollard 110. Such association may occur through employing the preferred adhesive of the associating means 106, by utilizing a mechanical fastener, or through any other suitable means. Thereafter, one or more retention devices 100 may additionally be associated with the bollard 110, depending on the needs and demands of the particular installation. If multiple devices 100 are so associated, they are preferably disposed so as to be in general opposition to each other about the bollard 110 or similar structure.

Once the device(s) 100 is so associated, the bollard cover 114 is then disposed about the bollard 110 and associated device(s) 100. More specifically, an open end of the bollard cover 114 is positioned atop the bollard 110 and then the bollard cover 114 is gradually lowered until it completely or nearly completely encapsulates the bollard 110 therewithin. In this orientation, the device(s) 100 is sandwiched between the bollard cover 114 and the bollard 110 to which it is secured. Once so sandwiched, the device(s) 100, more specifically its fingers 102, cooperate to oppose upward movement of the bollard cover 114 due to the frictional engagement between the fingers and the inside surface 115 of the bollard cover 114.

Although the invention has been described with regard to certain preferred example embodiments, it is to be understood that the present disclosure has been made by way of example only, and that improvements, changes and modifications in the details of construction and the combination and arrangement of parts may be resorted to without departing from the spirit and scope of the invention. Such improvements, changes and modifications within the skill of the art are intended to be covered by the scope of the appended claims.

What is claimed is:

1. A bollard cover retaining device adapted for retaining an elongate sleeve bollard cover about an elongate bollard, wherein the bollard cover retaining device comprises:

a substantially rectangular base member having a front face, a rear face, a longitudinal axis and a lateral axis, a shoulder along an edge of the rear face and extending substantially parallel to the lateral axis of the rear face, at least one projecting flexible flange, said flange having a foot adjacent said base, an upper generally planar surface, a lower generally planar surface and a flange end, the distance from said flange foot to said flange cord being significantly greater than the distance between said upper and lower surfaces, said flange extending laterally parallel to the lateral axis of the base member extending downwardly and outwardly from the base member, said flange being adapted to frictionally engage the inner surface of the elongate sleeve bollard cover;

and an associating means, associated with the rear face of the base member, adapted for associating the retaining device to the elongate member.

2. A bollard cover retaining device adapted for retaining a bollard cover on a bollard, said bollard cover retaining device having a flexible rectangular base, said rectangular base having a rear face adapted to be fixed to a bollard and a front face having at least one laterally extending flexible flange, said flange having at foot adjacent said base, an upper generally planar surface, a lower generally planar surface and a flange end, the distance from said flange foot to said flange end being significantly greater than the distance between said upper and lower surfaces, said flange projecting outwardly and downwardly from said base to said flange end, said flange end adapted to engage said bollard cover allowing said bollard cover to move downward in the direction said flange projects and resisting upward movement of said bollard cover, against the direction said flange projects.

3. The bollard cover retaining device of claim 2 having multiple parallel flanges spaced along the base.

4. The retaining device of claim 2, wherein the flange extends from the base member at an obtuse angle.

5. The retaining device of claim 4, wherein the flange upper surface and the flange lower surface extend substantially parallel to the lateral axis of the base member.

6. The retaining device of claim 2, wherein the rear face is adapted to be fixed to a bollard by a pressure sensitive adhesive.

7. The retaining device of claim 6, wherein the base member further comprises a shoulder extending from the rear face thereof, wherein the shoulder extends substantially parallel to the flexible flange.

8. The retaining device of claim 7, wherein the shoulder is disposed proximate an edge of the base member rear face.

9. A bollard cover retaining system for retaining a bollard cover relative to a bollard about which the bollard cover is disposed, wherein the system comprises:

an elongate bollard;

a bollard cover disposed about the bollard; and, at least one bollard cover retaining device having a flexible rectangular base, said rectangular base having a rear face adapted to be fixed to a bollard and a front face having at least one laterally extending flexible flange, said flange having at foot adjacent said base, an upper generally planar surface, a lower generally planar surface and a flange end, the distance from said flange foot to said flange end being significantly greater than the distance between said upper and lower surfaces, said flange projecting outwardly and downwardly from said base to said flange end, said flange end adapted to engage said bollard cover allowing said bollard cover to move downward in the direction said flange projects and resisting upward movement of said bollard cover, against the direction said flange projects fixed to said bollard.

10. The bollard cover retaining system of claim 9 wherein at least two retaining devices are fixed to said bollard spaced about the periphery of said bollard.

11. The bollard cover retaining system of claim 10 wherein said at least two retaining devices are mounted generally in opposition to one another one a circumference of said bollard.

12. The retaining system of claim 9, wherein the flange extends from the base member at an obtuse angle.

13. The retaining system of claim 9, wherein the flange upper surface and the flange lower surface extend substantially parallel to the lateral axis of the base member.

14. The retaining system of claim 9, wherein the rear face is adapted to be fixed to a bollard by a pressure sensitive adhesive.

15. The retaining system of claim 14, wherein the base member further comprises a shoulder extending from the rear face thereof, wherein the shoulder extends substantially parallel to the flexible flange.

16. The retaining system of claim 15, wherein the shoulder is disposed proximate an edge of the base member rear face.

* * * * *